United States Patent [19]

Coulter

[11] 4,005,517

[45] Feb. 1, 1977

[54] VACUUM CLEANER HOSE TERMINAL APPLICATOR

[75] Inventor: Raymond Arthur Coulter, Harrisburg, Pa.

[73] Assignee: AMP Incorporated, Harrisburg, Pa.

[22] Filed: June 23, 1975

[21] Appl. No.: 589,238

[52] U.S. Cl. ..... 29/748; 29/628

[51] Int. Cl.[2] ..... H01R 43/00

[58] Field of Search ..... 29/203 DT, 203 R, 203 D, 29/203 P, 33 M, 33 T, 628, 630 B, 564, 629, 203 MW

[56] References Cited

UNITED STATES PATENTS

| | | | |
|---|---|---|---|
| 3,412,596 | 11/1968 | Burns | 29/203 DT |
| 3,428,843 | 2/1969 | Keller | 29/203 DT |
| 3,484,936 | 12/1969 | Schwalm et al. | 29/203 DT |
| 3,570,097 | 3/1971 | Bowden, Jr. et al. | 29/203 DT |
| 3,733,697 | 5/1973 | Wickham et al. | 29/628 |
| 3,766,622 | 10/1973 | Brehm et al. | 29/203 MW |
| 3,857,154 | 12/1974 | Hammond et al. | 29/203 DT |
| 3,895,434 | 7/1975 | Adams et al. | 29/628 |
| 3,931,671 | 1/1976 | Dittmann | 29/203 DT |

*Primary Examiner*—C.W. Lanham
*Assistant Examiner*—Daniel C. Crane
*Attorney, Agent, or Firm*—Robert W. Pitts; Frederick W. Raring

[57] ABSTRACT

An apparatus and method for attaching slotted terminals to multiple interspaced helical insulated wires forming the skeleton of a flexible tubular hose is disclosed. Stationary cylindrical severing horns and insertion horns are utilized in conjunction with movable severing and insertion tooling. The flexible hose is positioned in surrounding relationship to the terminals and severing horns so that the wires may be forced into the slots in the terminal.

17 Claims, 17 Drawing Figures

6

10
18
19
68
14
64
60
66

VACUUM CLEANER HOSE TERMINAL APPLICATOR

BACKGROUND OF THE INVENTION

This invention relates to the attachment of contact terminals to electrically conductive wires. More particularly, it relates to a machine for inserting copper coated hard steel spring wires into terminals having slots which penetrate the insulation surrounding those wires and establish electrical contact with the underlying conductive core. This machine is capable of attaching terminals to the wires which form the skeleton of a tubular flexible hose such as that used with vacuum cleaners.

DESCRIPTION OF THE PRIOR ART

U.S. Pat. No. 3,314,039 discloses a flexible hose using conductive wires to form the skeleton of this hose. Application Ser. No. 569,421, now U.S. Pat. No. 3,972,578 discloses a slotted terminal which can be attached to these spring wires. The applicator machine comprising the present invention is intended to be used to attach these terminals to such wires.

Electrical connections utilizing slotted terminals to displace the insulation and establish contact with the underlying conductive core are well known in the prior art. Apparatus to be used for attaching such terminals to insulated wire are equally well known and are too numerous to mention. A tubular flexible hose, such as that used with vacuum cleaners, using helical hard steel copper clad spring wires as both the skeleton for the hose and an electrical conductor presents new termination problems. Slotted terminals known in the prior art act to deform the conductive core of wires to establish a good mechanical connection. The hard steel spring wire dealt with here causes significant deformation of the terminal itself. The instant invention furnishes an applicator capable of attaching such deformable terminals to hard steel wires. This invention also provides an efficient and practical method of handling the helical wires in a tubular hose.

SUMMARY OF THE INVENTION

The principal object of this invention is to provide a means of attaching terminals to the ends of helical wires which have sufficient spring like properties to serve as the skeleton of a flexible tubular hose. This invention is intended to attach terminals which extend along axial direction of the hose and are therefore transverse to the helical spring wires used as conductors. It is therefore, an object of this invention is to furnish a machine capable of handling any alignment problems generated by the use of helical wires. An additional object is to provide a machine capable of preparing the wire and hose for terminal attachment by cutting the wires on bias so that terminals of unequal length may be used. One further object of this invention is to provide means for cutting steel spring wires and attaching terminals to these hard wires.

To carry out these and other objects, this invention incorporates a cylindrical insertion horn which provides a rigid support for the terminal and for the hose when mounted in surrounding relationsip to the terminals. A movable inserter for attaching the terminals to the wires by moving the wires radially inwardly and into the wire receiving means of stationary terminals is utilized. Severing means for cutting the wires on bias together with appropriate stop means on the severing means and on the insertion horn are used. In this manner the terminals can be appropriately aligned on the hose.

BRIEF DESCRIPTION OF THE DRAWING

FIG. 3 shows the severing horns and the insertion horns as well as the movable severing and inserting means.

DETAILED DESCRIPTION OF THE DRAWING

Figure 1:
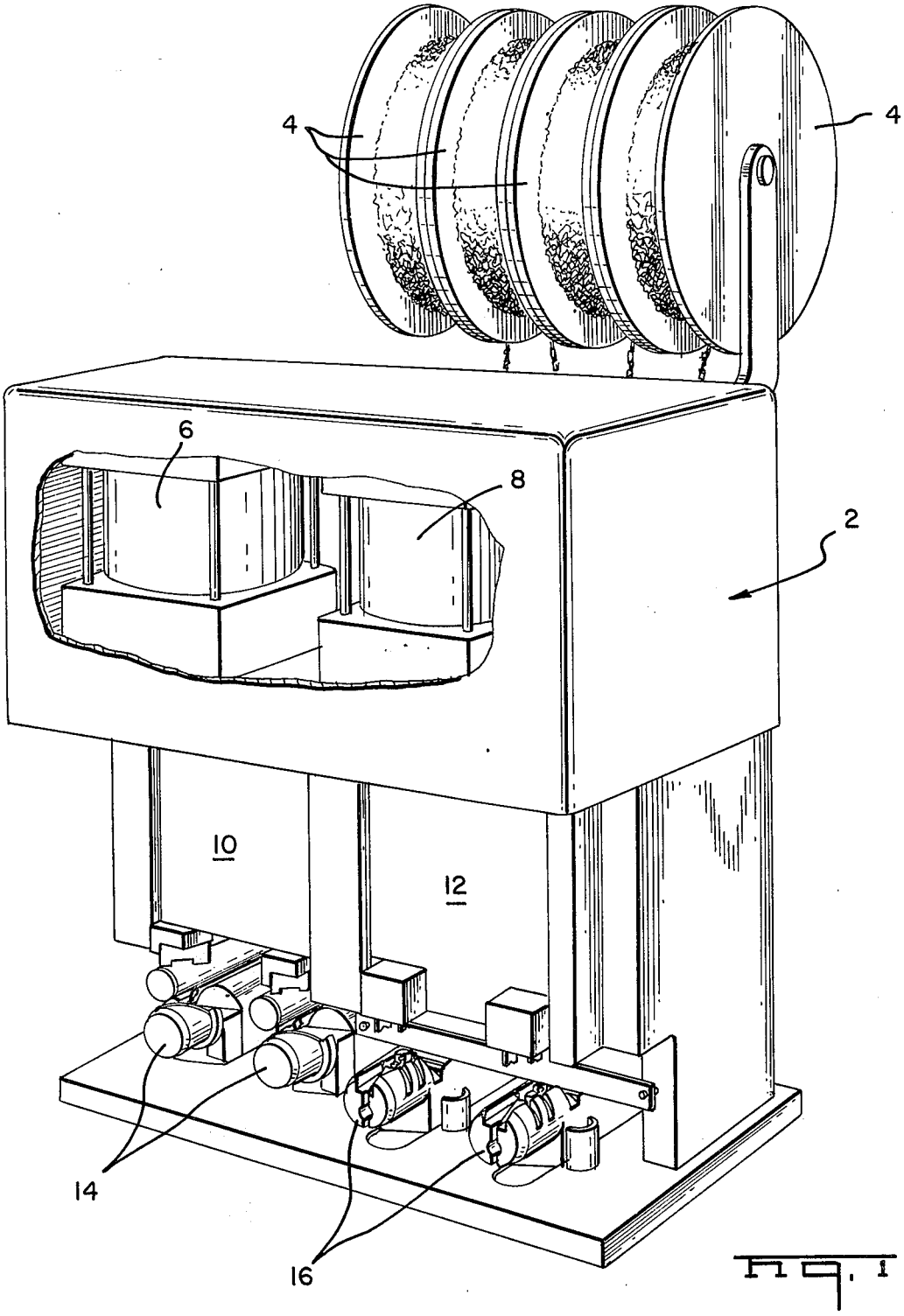
FIG. 1 is a view of the terminal applicator machine.
Figure 2:
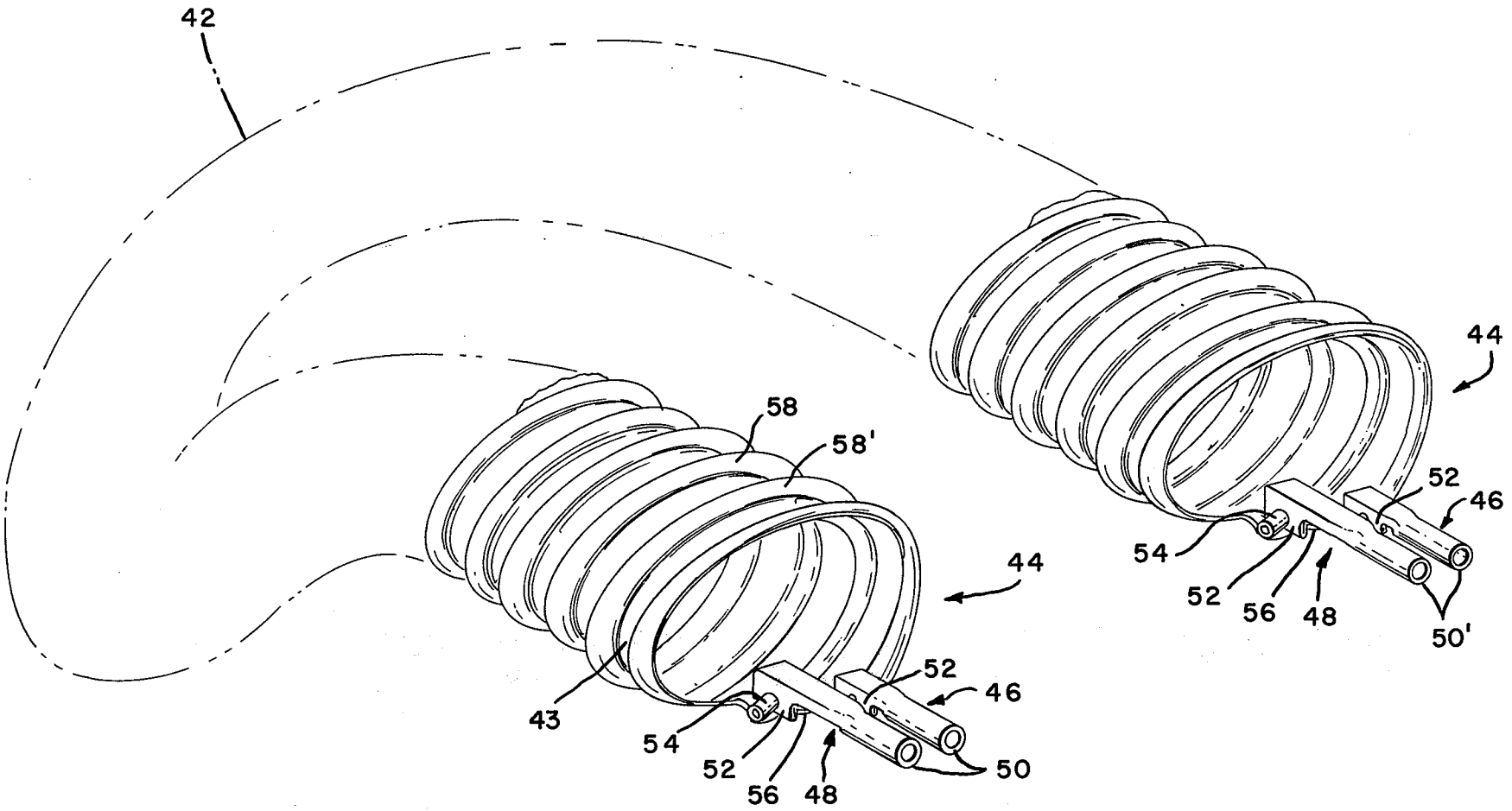
FIG. 2 shows the flexible hose with terminals attached at each end.
Figure 1:
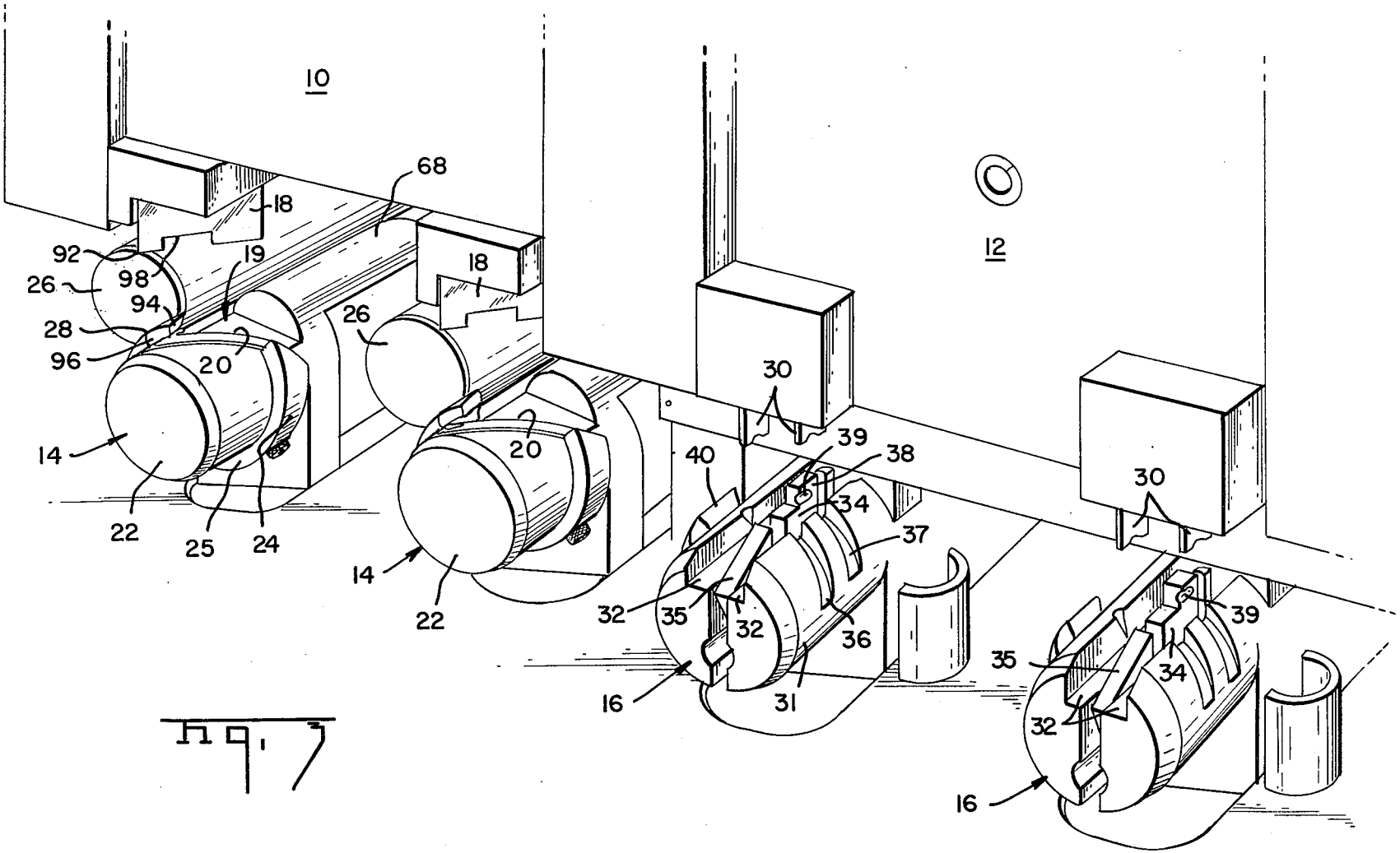

FIG. 1 shows the principal features of this terminal applicator machine intended for use with hose and terminals shown in FIG. 2. This machine 2 has four cylindrical horns located near the base of the machine. Two identical severing horns 14 are designed to sever the hose and spring wires along a bias in preparation for the insertion operation. The other two horns 16 provide a support for the terminals and the end portions of the flexible hose so that the terminals can be attached to the wires. This machine has a severing piston 6 and a insertion piston 8 corresponding to movable severing tooling 10 and insertion tooling 12 respectively. The movable severing tooling 10 moves downwardly toward severing horns 14 to cut the flexible hose. Likewise, insertion tooling 12 moves downwardly toward insertion horns 16 to attach the terminals. Four reels 4 containing contact terminals are shown. These reels simultaneously supply two terminals to each insertion horn 16. FIG. 3 is a more detailed view of a severing and insertion stations showing both the movable and stationary severing and insertion means.

FIG. 2 shows a flexible hose 42 with terminals 46, 48 attached to both ends. Flexible hose 42 has an outer covering or web 43 which may be of material such as plasticized polyvinyl chloride. Helical spring members 58 and 58' form the skeleton of this flexible hose. These spring members are of hard spring steel and have a copper coating to facilitate electrical conductivity. The spring wires themselves are completely insulated and together with the outer skin a dual layer of insulated material is formed on the outer surface of the hose. Hose 42 has two separate helical spring members 58 and 58' interspaced about a common central axis.

Side-by-side terminals 46 and 48 are shown attached to each end of the flexible hose. The two terminals on each end are essentially parallel to each other and extend parallel to the axis of revolution of the tubular hose. This orientation requires that terminal 48 attached to the inner wire be longer than terminal 46 attached to the outer wire.

These terminals have two parallel spaced apart sidewalls 52. Each side wall has diagonally spaced wire-receiving means. In this particular embodiment, the sidewalls have wire-receiving slots 54 which penetrate the insulation surrounding the wire and establish contact with the conductive core of the wire. These terminals and flexible hose are described with more detail in application Ser. No. 569,421.

Figure 4:
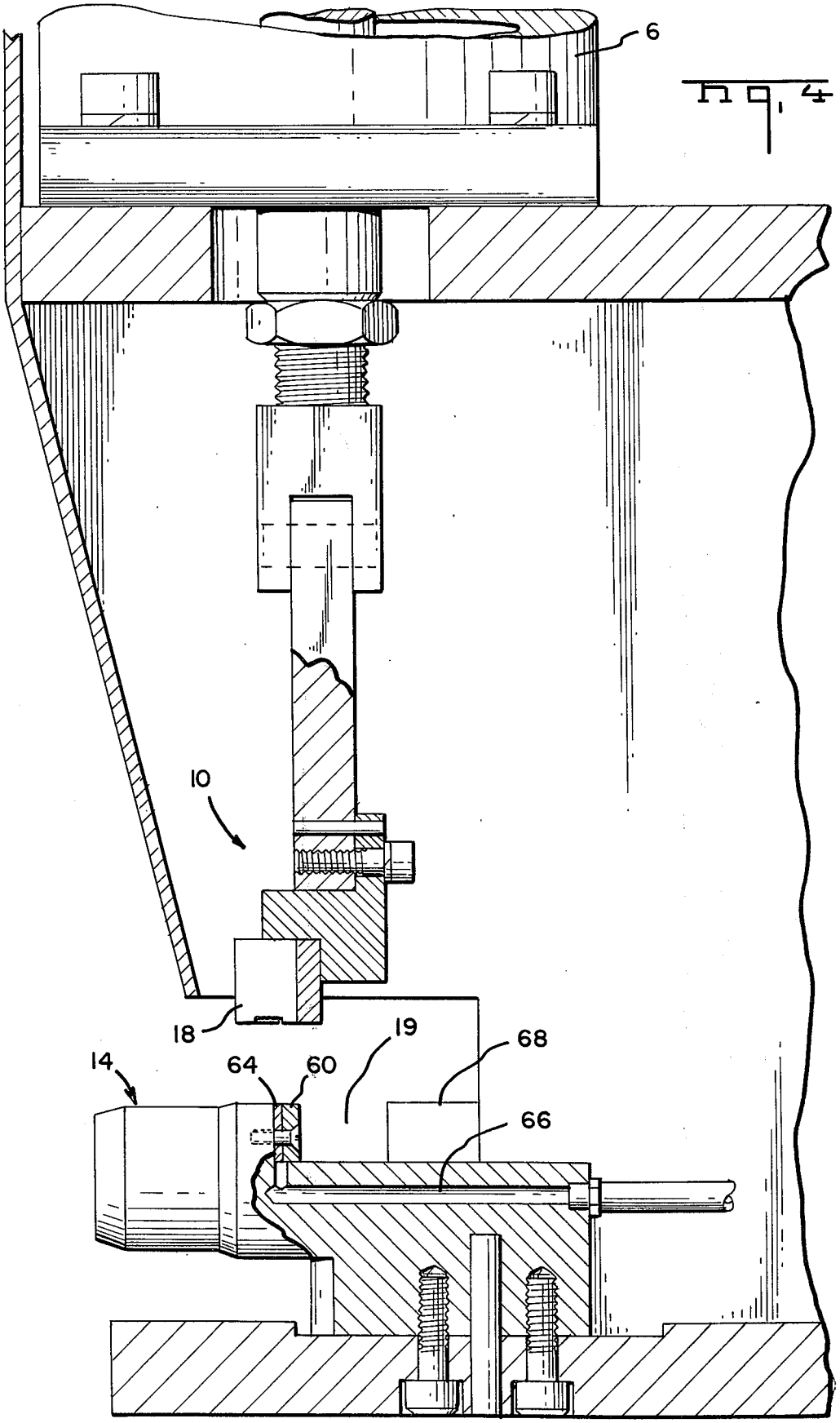
FIG. 4 is a sectional view taken through the severing horn and movable severing means.
Figure 5:
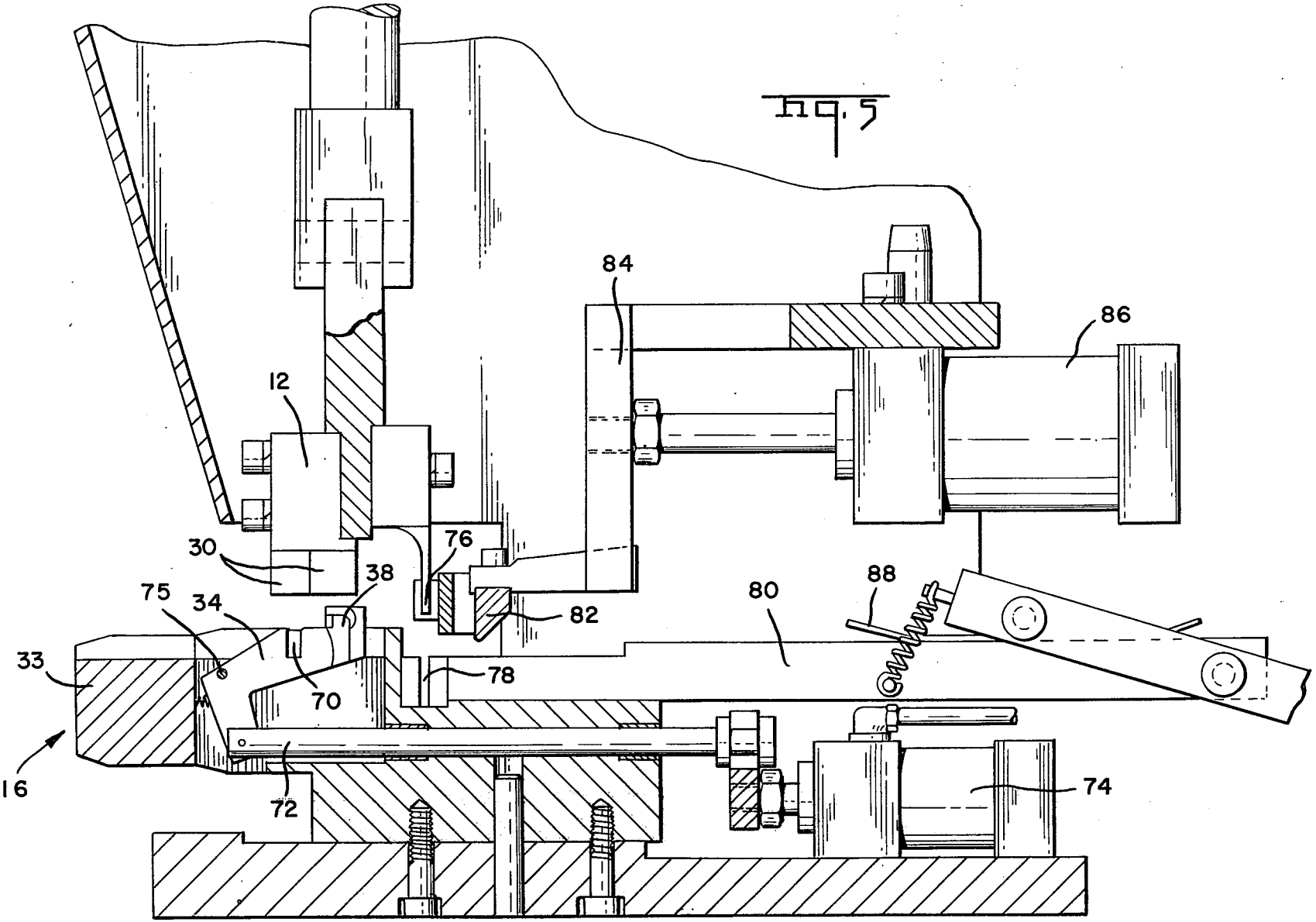
FIG. 5 is a sectional veiw taken through the insertion horn showing the movable inserter and terminal feed mechanism.
Figure 6:
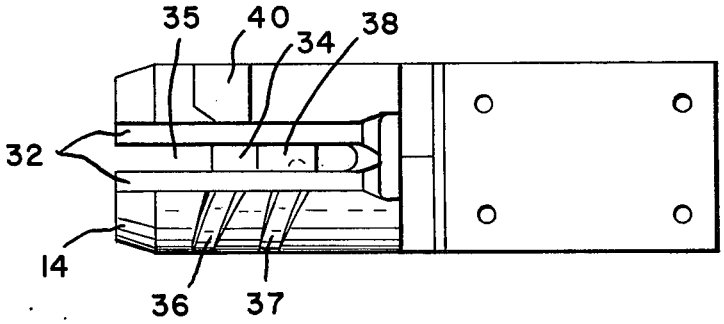
FIG. 6 is a top view of the insertion horn.
Figure 7:
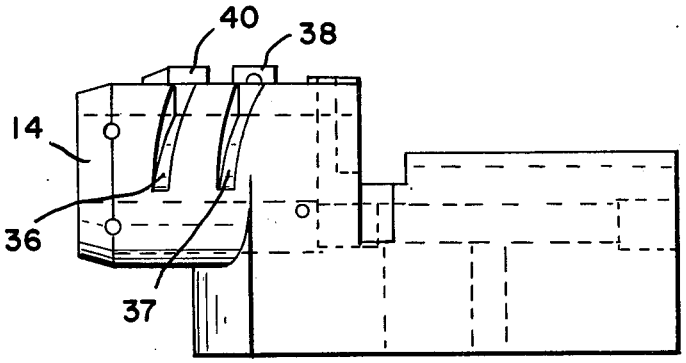
FIG. 7 is a side view of the insertion horn.

FIGS. 3, 4, and 5 show the general working features of this machine. FIG. 4 is a sectional view of the severing work station showing both the movable severing means 10 and the severing horn 14. Severing blade 18 is attached at the bottom of movable severing tooling 10 which in turn is actuated by severing piston 6. A fixed shear blade 60 having fixed severing edge 20 is mounted on severing horn 14 in alignment with severing blade 18. Downward movement of piston 6 causes severing blade 18 to engage severing blade 60 as the severing means 10 moves into seat 19 formed in the severing horn. An air supply line 66 leads through the interior of severing horn 14 and exhausts in the form of an air jet 64 which blows the severed chip away from the flexible hose 42 when it is mounted on severing horn 14.

FIG. 5 is a sectional view of the insertion work station showing movable insertion tooling 12 and the fixed insertion horn 16. Two stuffer blades 30 which can be seen in FIG. 3 and FIG. 5 are located on the lower surface of insertion tooling 12. A shear blade 76 is located on the rear of the insertion tooling and is spaced from stuffer blades 30. Shear blade 76 is intended to separate individual terminals as they move along terminal feed track 80. Terminals are fed from reels 4 to insertion stations located in each insertion horn 16 by means of a feed system which is shown in FIG. 5. This terminal feed system comprises terminal feed track 80, terminal feed finger 82, piston 86 and terminal drag 88. Feed piston 86 causes feed finger 82 to move to the left in FIG. 5 by means of an actuating system generally shown as 84. As feed finger 82 moves to the left, it causes a continuous row of terminals to move along feed track 80. Terminal drag 88 exerts a positive drag which helps regulate movement of the terminals along track 80.

FIG. 5 also shows retractable central rib 34. This central rib is located in the insertion horn 16 and is stationed directly beneath movable insertion tooling 12. This central rib is located between the two rows of terminals and forms two channels 32 in the insertion horn 16. These channels can be seen more clearly in FIG. 3. Central rib 34 is attached to piston 74 by means of actuator arm 72. Movement of the piston to the left in FIG. 5 causes rotation of rib 34 about pivot 75. This rotation causes the central rib to retract into the body of insertion horn 16 and opens channels 32 so that terminals may be removed from insertion horn 16.

Pistons shown in FIGS. 1–5 as well as air jet 64 form an integral pneumatic system for driving this machine. In this machine, severing piston 6 and terminal feed pistons 86 are simultaneously actuated and accompanying air jet 64 removes any scrap severed from hose 42. Terminals are now in position on the insertion horns 16 and flexible hose 42 may be positioned on the insertion horns. Terminal applicator piston 8 is then actuated and the wires are forced into the wire receiving means of the terminal. Terminal release cylinder 74 is next actuated to retract central rib 34. Flexible hose 42 now has terminals 46, 48 attached to both ends and it can be removed from insertion horns 16. This represents a complete cycle of this machine.

Figure 9:
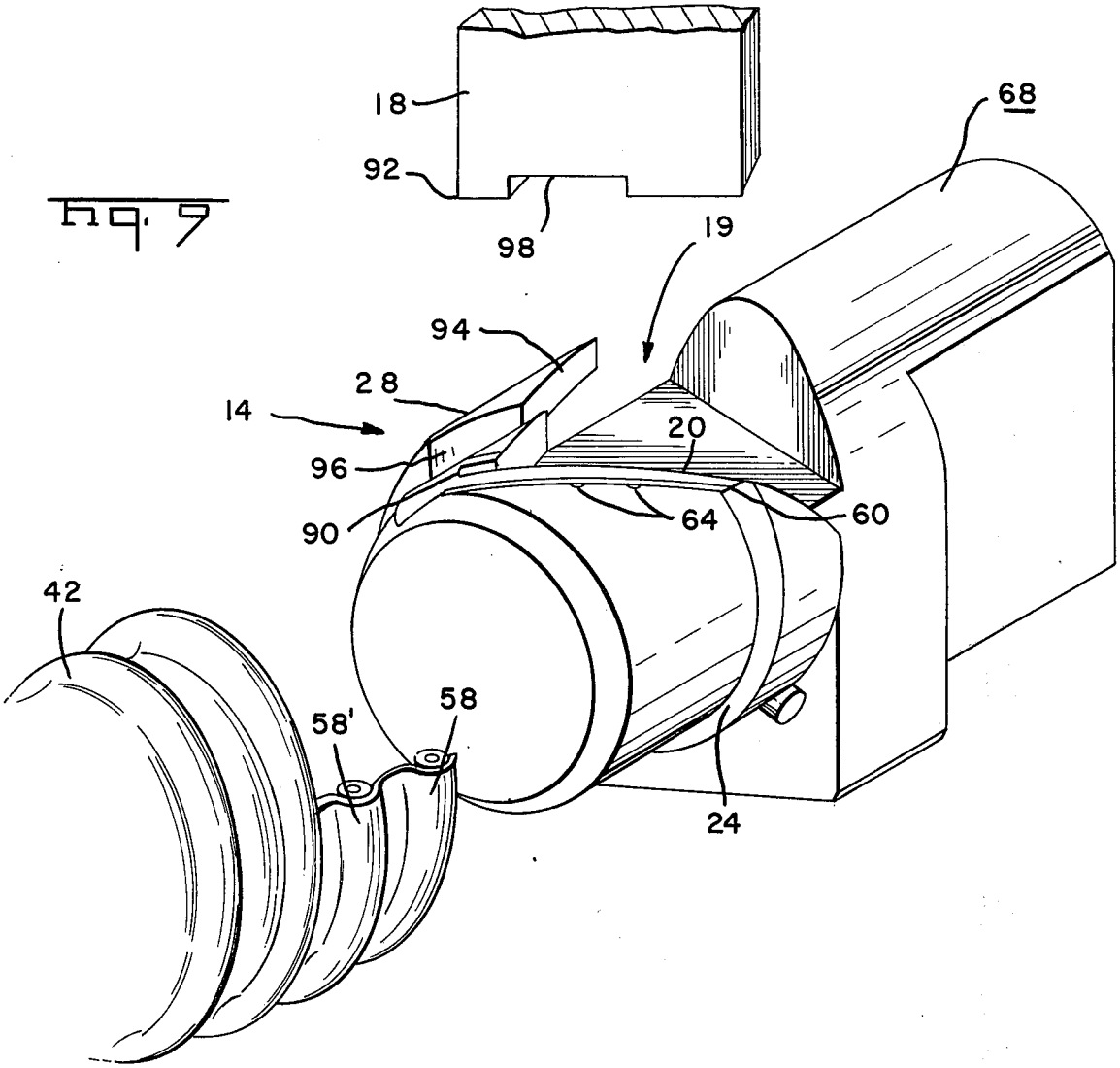
FIG. 9 is a perspective view of the severing station showing the hose in position to be cut.
Figure 10:
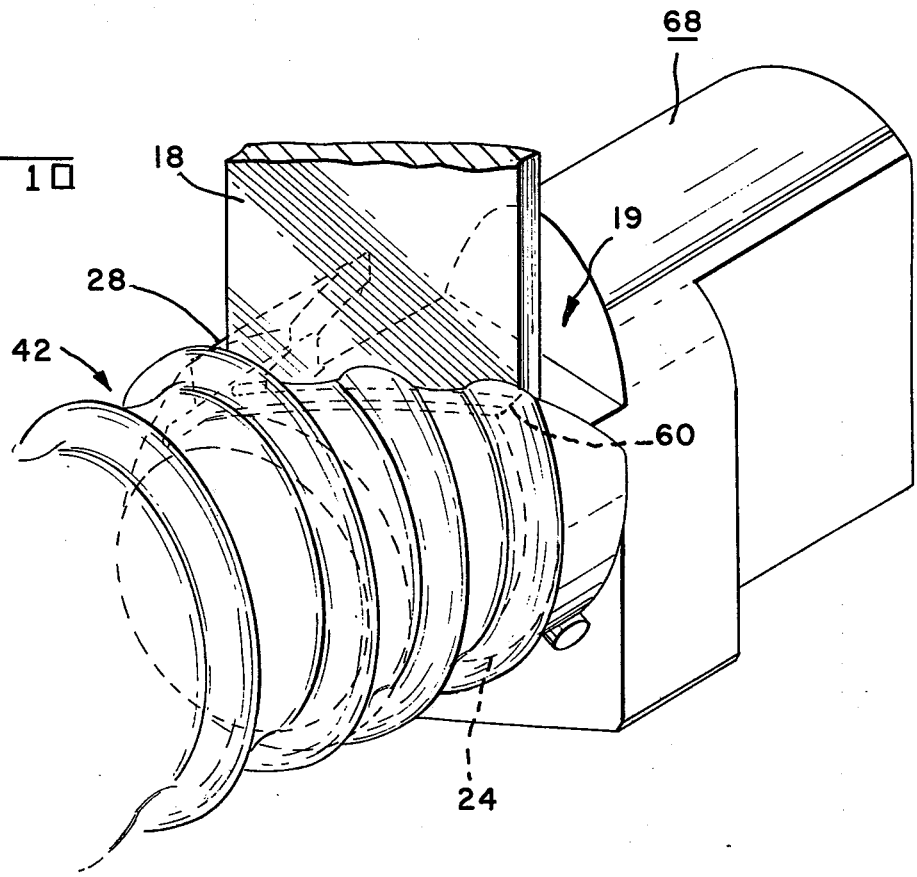
FIG. 10 shows the severing station as the hose is cut.

The details of severing horn 14 are shown in FIGS. 9 and 10. The outer portion of an individual severing horn comprises an essentially cylindrical barrel or body portion. This barrel or body portion serves to support an end portion of a flexible hose 42. The hose is positioned around severing horn 14. Severing horn 14 has a recess 19 in the upper portion of the cylindrical body. A fixed severing blade 60 is located at the forward edge of recess or seat 19. This severing blade has a flat edge 20 which serves as the severing surface. The severing blade 60 is essentially rectangular and in this embodiment, is made of a hard cutting material such as carbide. Another fixed shear blade is shown positioned next to blade 60. This second shear blade forms a cusp 90 and is positioned to the left of shear blade 60 in FIG. 9. The cusped shear 90 need not be made of a material as hard as carbide. Severing horn 14 has two stops which are used to position flexible hose 42. Hose end stop 24 comprises a ring mounted on the exterior of the cylindrical body of severing horn 14. Stop 24 has an outwardly extending face 25 which defines a helix. Severing means 14 has a second stop 28 mounted on the opposite side of horn 14 adjacent to cusp 90. This stop extends above the surface of the cylindrical body and face 94 on stop 28 extends axially along severing horn 14. FIG. 9 shows movable severing blade 18 positioned above severing horn 14. Severing blade 18 has a central insert 98 so that blade 18 has two offset but parallel severing edges. Blade 18 has a rounded end 92.

Figure 8:
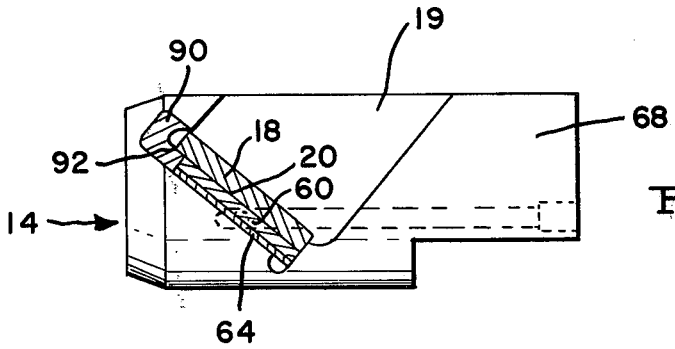
FIG. 8 is a top view of the severing horn showing movable cutter blade positioned against the stationary severing blade.

FIG. 8 is a top view of a severing horn 14. This view shows movable severing blade 18 positioned against the fixed shear blades 90 and 60. A shear line roughly in the shape of a J is formed by the intersection of the movable and fixed shear blades.

Figure 11:
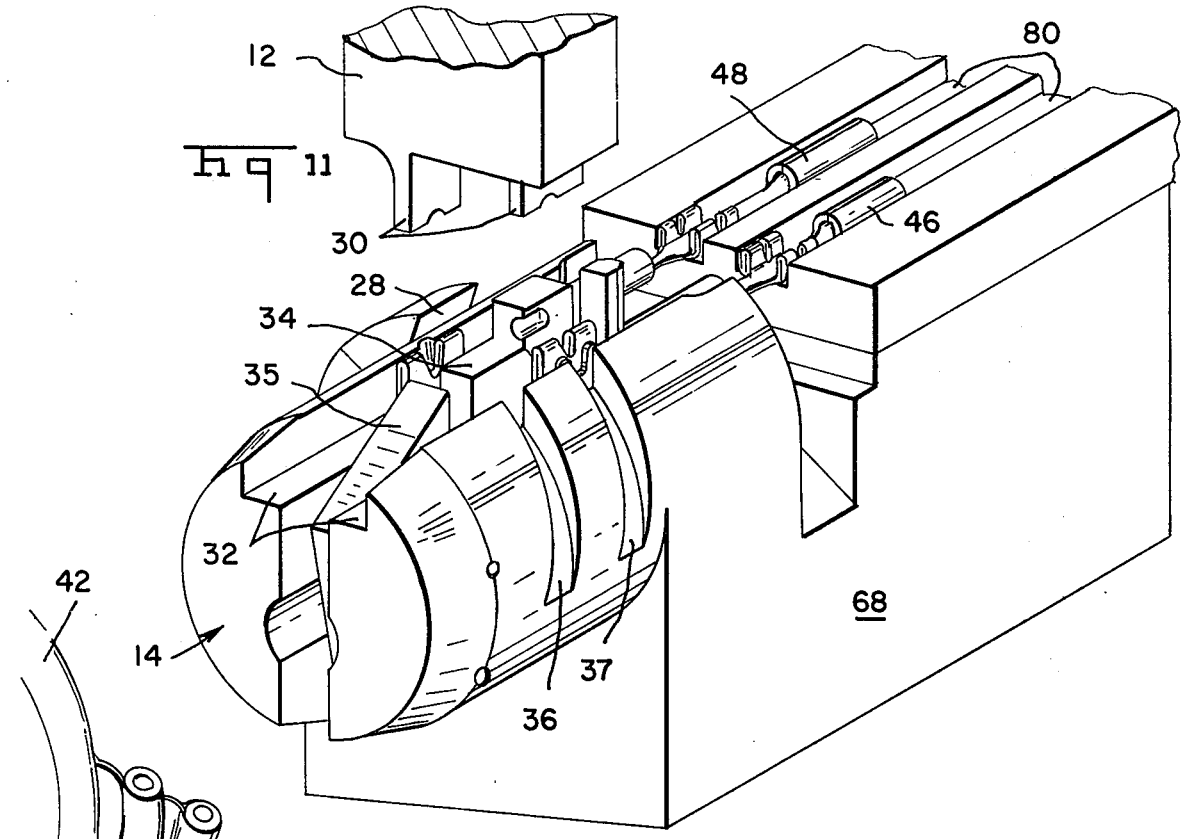
FIG. 11 shows the insertion station with a hose in position for attachment of the terminals.
Figure 12:
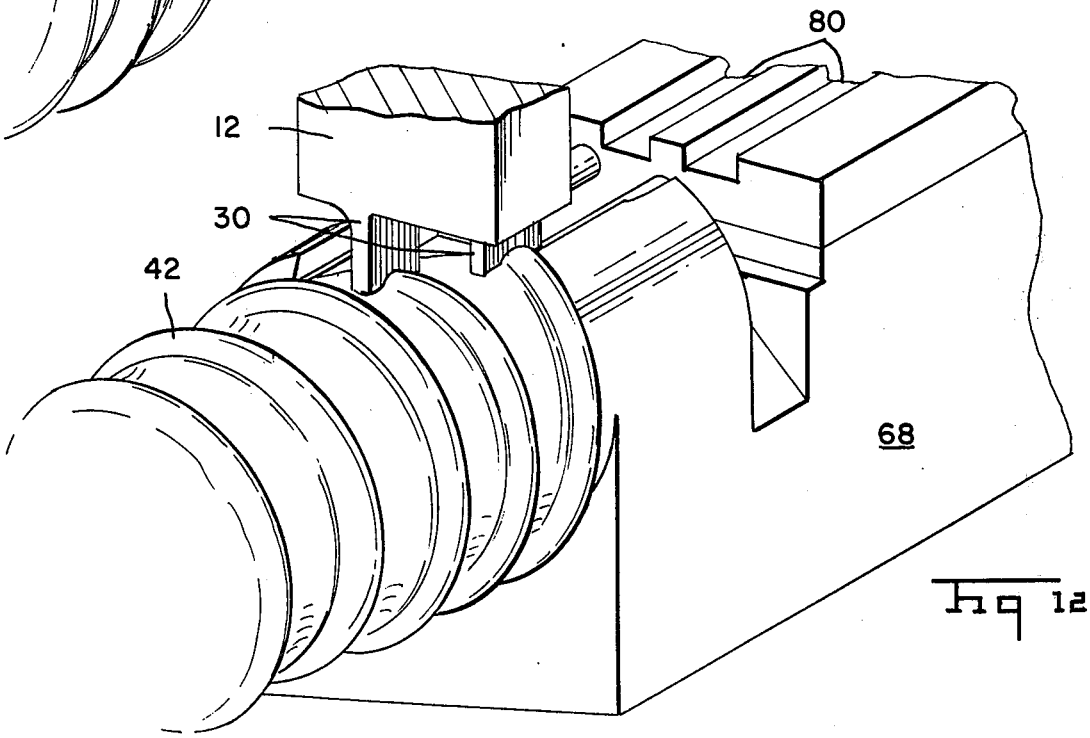
FIG. 12 shows the insertion station after the terminals have been attached.

A single insertion horn 16 is shown in FIGS. 11 and 12. This insertion horn has a cylindrical barrel or body 31 which is of the same diameter as severing horn 14. The cylindrical body 31 serves as a support for the flexible hose 42 in much the same manner as severing horn 14. Horn 16 has two axial channels 32 formed along the upper surface of cylindrical body 31. These two channels 32 are separated by retractable central rib 34. End extension 33 shown in FIG. 5 has been removed in FIG. 11 so that the central rib 34 can be seen. Two helical grooves 36 and 37 extend into the body of horn 16. These helical grooves 36 and 37 extend into the body of horn 16. These helical grooves 36 and 37 are located generally in the upper right quadrant of horn 16. The depth of these grooves is continuously increasing in the counterclockwise direction in FIG. 11. These grooves 36 and 37 intersect channels 32 and reach a maximum depth at the point of intersection. At this point, the grooves and the channels are of essentially the same depth. Central rib 34 has a slanted forward surface 35 and one of the grooves 36 extends across central rib 34 immediately aft of forward surface 35. Insertion horn 16 has two wire stops 38 and 40 shown in FIG. 3. Wire stop 38 is aligned with the rear groove 37 and is located on the central rib just behind the intersection of the forward groove. Stop 38 has a cusped portion 39 aligned with the rear groove 37. Stop 40 is located on the left of horn 16 and it is aligned with the front helical groove 36.

Figure 9A:
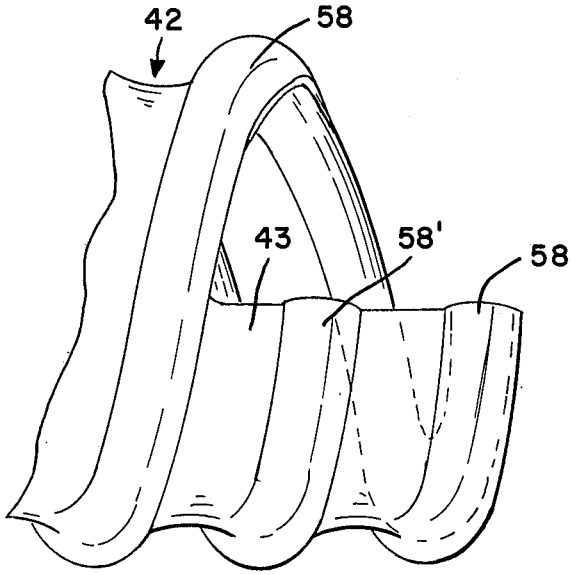
FIG. 9A shows the end of the hose prior to the cutting.
Figure 10A:
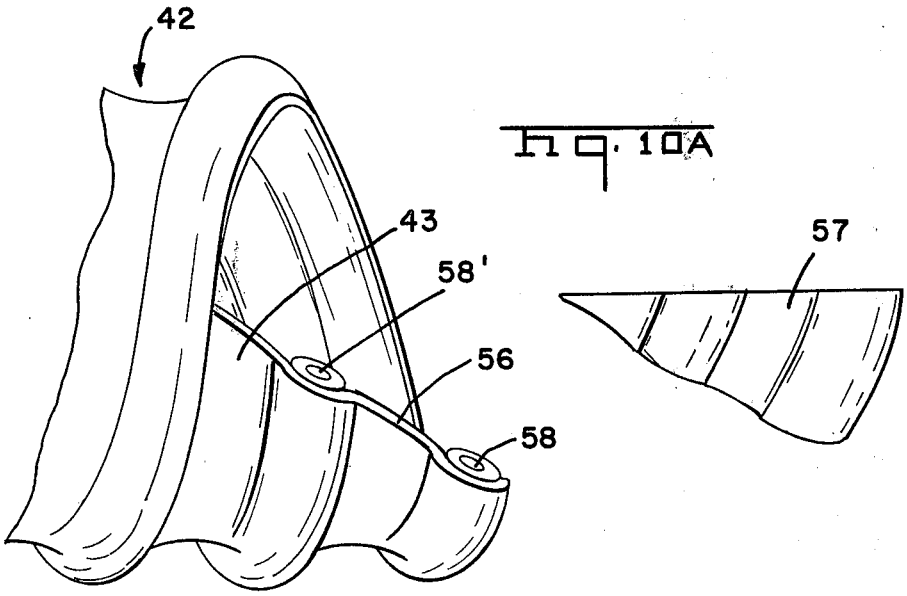
FIG. 10A shows the hose after cutting.

FIGS. 9–12 illustrate the principal steps in the operation of this applicator. FIGS. 9 and 10 demonstrate the manner in which the hose is trimmed prior to attachment of the terminals. The end of the hose has been initially cut along a line parallel to the axis of the tubular hose. FIG. 9A shows this initial condition. The two ends 44 of hose 42 are placed on side by side severing horns 14. An operator merely grasps each end of the hose and simultaneously pushes the ends over both horns. Each severing horn has a helical hose stop 24. The ends of hose 42 are first pushed up against this stop. The hose is then rotated in a counterclockwise direction until the outer wire abuts wire stop 28. The inner wire does not abut any wire stop. This prevents any kinking and ensures a straight cut along a bias 56. Once the hose has been fully positioned on severing horns 14, the operator actuates severing piston 6 and movable tooling 10 moves the hose into contact with the horns 14. Movable severing plates 18 and fixed severing blades 60 are each carbide blades capable of cutting hard steel spring wires. Movable severing blade 18 is staggered having a central offset 98. This offset allows movable severing blade 18 to contact the two wires at different times and in this way, each wire is cut separately. Less force is therefore, required for the severing operation. FIG. 10A shows the end of hose 42 after it has been cut along a bias 56. Chip 57 is also shown in this Figure.

Movable severing blade 18 has a rounded end 92 which moves into a cusp 90 on the fixed severing surface. This results in a J-shaped cutting surface which ensures that the entire chip is completely severed from the main portion of the hose. Cusp 90 cuts only the flexible cover of the hose and need not be carbide since no wires are cut. At this point, chip 57 is blown away from severing horn 14 by an exhaust from an air jet 64 located just ahead of fixed shear plate 60. The chip is blown into hose 26 and is removed from the operating area of the machine.

Figure 14:
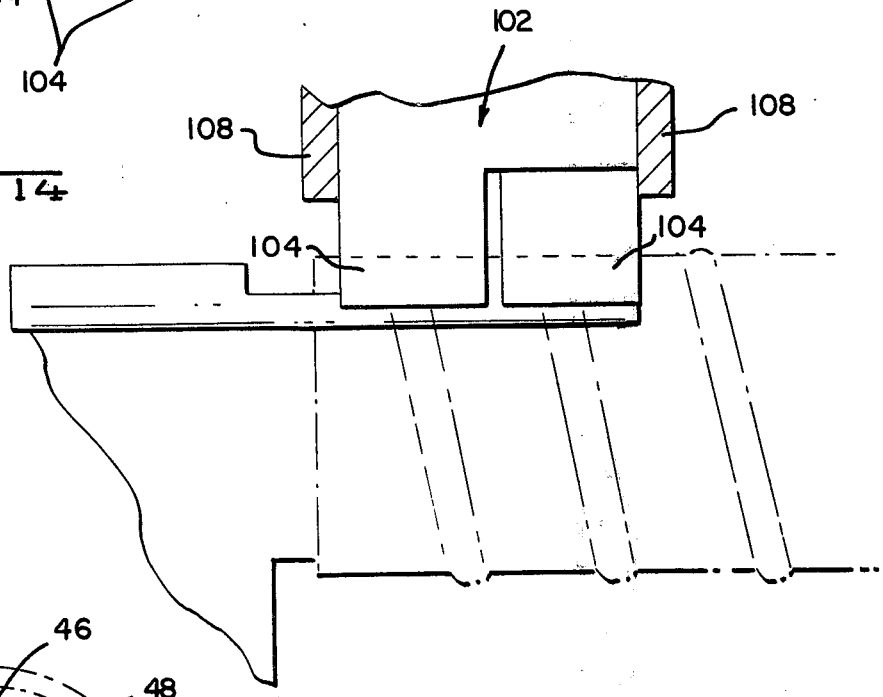
FIG. 14 is a sideview showing the operation of this alternate embodiment.
Figure 15:
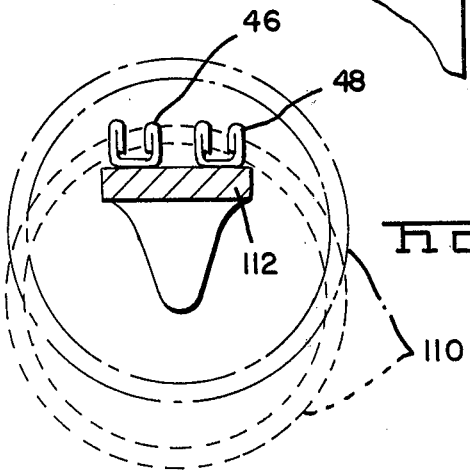
FIG. 15 is a view showing the essentials of the movement of the wire into the terminals.

The hose has now been prepared for installation of two terminals on each end. The operator merely pulls the hose from the two horns 14 and places them over insertion horns 16. Insertion horns 16 each have two wire stops 38 and 40. Rear stop 38 is centrally located on the top of the horn and each hose is rotated counterclockwise until the outer wire abuts wire stop 38. Wire stop 38 has a cusp 39 and the outer wire is positioned in this cusp. The hose is again rotated counterclockwise until the inner wire abuts wire stop 40 which is offset to the left of each insertion horn. Hose 42 is now in position for attachment of terminal 46 and 48 which have been previously fed into position on the inside of hose 42. The operator now actuates insertion piston 8 driving movable insertion tooling 12 towards the hose and supporting insertion horns 16. FIG. 12 shows that wire stuffers 30 initially contact the two separate hose wires and push them down into slots 54 of terminal sidewalls 52. Helical grooves 36 and 38 have been provided in insertion horns 16. The depth of these grooves is continuously increasing so that a substantial portion of each wire is flexed downwardly into these grooves. These grooves are important since deformation of the wire ends would occur if the wires were not free to flex. Deformation of the wire ends would result in improper alignment of the terminals on the hose. Deformation can also be prevented by utilizing a system such as that shown in FIG. 14. In that alternate embodiment, the entire hose guide means 110 moves downward while the terminal support means 112 remains fixed and the wire is then inserted into stationary terminals 46 and 48. Each of these separate embodiments demonstrate the methods of preventing deformation of the wire ends.

Figure 13:
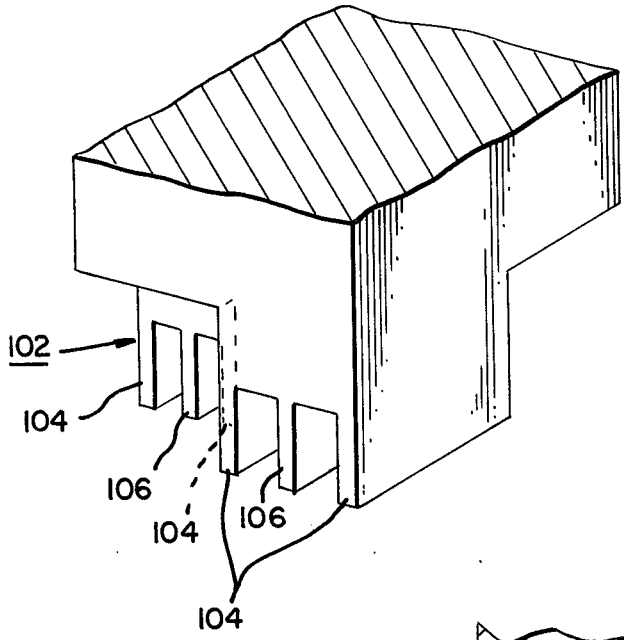
FIG. 13 is an alternate embodiment of this invention.

As the hard steel spring wire moves into terminals which are composed of a softer metal such as berillium copper, the steel wires tend to deform both the slots 54 and the terminal sidewalls 52. To prevent lateral deformation of the sidewalls, some lateral support must be provided. In the embodiment of FIG. 12, the walls of channels 32 provide this lateral support. The channels are only slightly wider than the terminals. After insertion of the wires into the terminals, the terminals are wedged into channels 32 and some means of removing the terminated hose must be provided. In the embodiment of FIG. 12, a retractable central rib is utilized. This central rib merely retracts into the body of insertion horns 16 freeing the terminals. FIG. 13 shows a slightly different embodiment. In this embodiment, the lateral support is provided by sidewalls 104 on alternate insertion tooling 102. These movable sidewalls act in the same manner as the walls of stationary channels 32. A terminal release mechanism is still necessary, however. In the embodiment of FIG. 13, this release mechanism comprises stationary means 108. As movable insertion tooling 102 returns to its initial position by moving in the upward direction, the terminals initially move with insertion tooling 102. As movable insertion tooling 102 is retracted in an upward direction, the terminals initially move with inserter 102. They soon, however, abut release means 108 and are stripped from inserting tooling 102 as it continues its upward travel.

The basic invention represented by the disclosed embodiments furnishes a practical means of applying an electrical contact terminal to a wire having a relatively harder central core. Two terminals extending parallel to the hose axis, parallel to each other, and attached to interspaced helical wires represent the end result of this operation. The final product, however, might include a plastic molding on the end of the hose. Although this invention does not encompass the application of such a molding, rather insignificant modifications could be made to the present invention which would be preparatory to the molding process. For an example, the plastic outer webbing of the hose might need to be partially severed between adjacent skeletal wires to partially free the end of the hose. This severing operation could be incorporated into the severing operation performed on horns 14. A change in the geometry of the mating cutting surfaces would be required.

Changes in construction will occur to those skilled in the art and various apparently different modifications and embodiments may be made without departing from the scope of the invention. The matter set forth in the foregoing description and accompanying drawings is offered by way of illustration only.

I claim:

1. Apparatus for attaching a terminal having a wire receiving portion to a helical wire; said apparatus comprising:

a generally cylindrical horn for supporting a portion of said wire on the exterior surface of said cylindrical horn with said wire in surrounding relationship to said cylindrical horn, a terminal support surface on said cylindrical horn, said terminal support surface being located radially within said exterior surface, terminal positioning means for positioning one of said terminals on said terminal support surface with said wire receiving portion in alignment with said portion of said wire, and moveable wire insertion means moveable towards and away from said terminal support surface, said wire insertion means moving in a radial direction past said exterior surface of said cylindrical horn to flex said portion of said wire radially inward into said wire receiving portion, whereby an electrical and mechanical connection between said terminal and said wire is achieved.

2. An apparatus as set forth in claim 1 for attaching a helical wire to a terminal, said terminal having a wire receiving portion comprising parallel sidewalls with a pair of aligned slots, one in each said slots having edges for contacting a wire inserted therein; said cylindrical horn having terminal sidewall support means adjacent to said terminal support surface.

3. Apparatus as set forth in claim 2 wherein said cylindrical horn has a channel extending axially along, and within said exterior surface of said channel comprising said terminal support surface and the sides of said channel comprising said terminal sidewall support means.

4. Apparatus as set forth in claim 3 for use with two separate helical wires, interspersed about the same axis, for attaching terminals to both wires, wherein two parallel channels separated by a central rib extend axially along said cylindrical horn, said central rib being moveable between extended and retracted positions, said central rib providing lateral support for said sidewalls when in said extended position during insertion of said wires into said wire receiving portions, said central rib then being movable to said retracted position to release said terminals from said channels.

5. Apparatus for attaching terminals to electrical wires, said wires comprising helical spring members mounted along the tubular wall of a flexible hose and supporting said tubular walls, said terminals having parallel spaced apart sidewalls with wire receiving means in said sidewalls, said apparatus comprising:

terminal support means for rigidly positioning said terminals with said wire receiving means facing outwardly from said support means, hose guide means for positioning said hose with said terminals adjacent to the end of said hose and within the circumference of said hose, movable insertion means movable radially towards and away from said terminal support means, said insertion means capturing the end portions of said wires at a location spaced from the location of said terminals and translating the end portions of said wires towards said terminals and, upon continued travel of said insertion means, said insertion means inserts said wires into the wire-receiving means on said terminals, and terminal feed means for positioning said terminals on said terminal support means, whereby said terminals can be attached to the ends of said wires which form the spring members supporting said flexible hose.

6. An apparatus as set forth in claim 5 wherein terminal releasing means are provided to free said terminals from said terminal support means after insertion of said wires into said wire-receiving means.

7. An apparatus as set forth in claim 5 wherein said hose guide means is fixed with respect to said terminal support means so that upon movement of said insertion means towards said wire support means, said end portions of said wires are deflected with respect to the remainder of said hose in order to move said end portions into said wire receiving means.

8. An apparatus as set forth in claim 7 wherein said terminal support means and said hose guide means comprise a cylindrical horn having a diameter substantially equal to the inner diameter of said flexible hose.

9. Apparatus for inserting a wire into the wire-receiving portion of an electrical contact terminal, said wire comprising a spring in the form of a helix, said terminal having a contact portion and a wire-receiving portion, said portions having a common axis, said wire-receiving portion being adapted to receive a wire extending transversely of said axis, said apparatus comprising:

a generally cylindrical supporting and insertion horn, said horn being dimensioned to receive said helix so that said helix is in surrounding relationship to said horn, said horn having a terminal-receiving channel means extending axially on the surface thereof and having wire receiving groove means extending transversely on the surface thereof, said wire-receiving channel means intersecting said terminal receiving groove means, and wire inserting ram means movable radially relatively towards and away from said terminal receiving channel means whereby, upon positioning a terminal in said terminal-receiving channel means with said wire-receiving portion at the intersection of said terminal receiving channel means and said wire-receiving groove means, and upon positioning said helix in surrounding relationship to said horn with portions of said wire in alignment with said wire-receiving channel means and upon relative movement of said ram means towards said horn, said portions of said wire are moved into said wire-receiving groove means and into said wire-receiving portion of said terminal thereby to connect said wire to said terminal.

10. Apparatus as set forth in claim 9 wherein said terminal is positioned in said terminal receiving channel means by terminal feed means, said feed means being axially aligned with said channel means so that said terminal is moved along said feed means and axially into said channel means.

11. Apparatus as set forth in claim 9 for use with a terminal with said wire receiving portion comprising slot means located in upstanding sidewalls wherein the depth of said channel means is at least equal to the height of said sidewalls so that said channel means provide lateral support to said sidewalls upon insertion of said wire into said slot means.

12. Apparatus as set forth in claim 9 wherein said wire receiving groove means form a helix extending partially around said horn on one side of said terminal receiving channel means.

13. Apparatus for attaching a terminal to an electrically conductive wire, said wire being mounted along the tubular wall of a flexible hose, said wire forming a helix, said terminal having parallel spaced apart sidewalls with wire-receiving means in said sidewalls, said apparatus comprising:

a work station for attaching said terminal to said wire, said work station comprising a stationary rigid support for said terminal, hose positioning means for guiding said hose into position at said work station, said hose being moved along its axis along said hose positioning means to said work station, terminal positioning means for moving said terminal axially with respect to said flexible hose and said hose positioning means into position at said work station with said wire receiving means aligned with said wire at a point adjacent to the end of said flexible hose, said hose being in surrounding relationship to said terminal, and insertion means for moving the end portion of said wire radially with respect to said hose thereby flexing the end portion of said hose and into said wire receiving means, whereby said wires are inserted into said terminals by movement of said wires.

14. An apparatus as set forth in claim 13 wherein said hose has two wires forming interspaced helixes and said terminal positioning means has side-by-side means for moving two terminals into position at said work station with the wire receiving means of each terminal being aligned with separate wires.

15. An apparatus as set forth in claim 14 wherein said apparatus is provided with hose severing means for severing the end of said hose on a bias transverse to the axis of said hose so that said wires are of unequal length and the ends of said wires may be aligned with side-by-side terminals.

16. Apparatus for attaching terminals to electrical wires, said wires comprising helical members mounted along the tubular wall of a flexible hose said terminals having parallel spaced apart sidewalls with wire receiving means in said sidewalls, said apparatus comprising:

severing means comprising stationary severing horn means for supporting the end of said flexible hose when the end of said hose is positioned in surrounding relationship to said severing horn, and movable severing means movable towards and away from said stationary severing horn means, said stationary severing horn means and said movable severing means having mating severing edges, said severing edges being transverse to the helix formed by said wires, insertion horn means for supporting the end of said flexible hose when the end of said hose is positioned in surrounding relationship to said insertion horn, said insertion horn means having channel means extending axially along said insertion means, said insertion horn means having grooves extending transverse to said channel means, said grooves forming a partial helix around said insertion horn means corresponding to the helix formed by said wires on said hose, said insertion horn means having stop means disposed to position the severed ends of said wires in alignment with said grooves and with said wires intersecting said channel means, movable insertion means movable radially towards and away from said insertion horn means, said movable insertion means having stuffer means aligned with the intersection of said grooves and said channels on said insertion horn means, and terminal feed means for advancing said terminals along said channel means until said wire receiving means in said sidewalls are positioned at the intersection of said grooves and said channel means, whereby said terminals may be attached to the ends of said wires so that said wires may be attached to electrical hardware at either end of said hose.

17. An apparatus as set forth in claim 16 wherein the depth of said grooves increases from the point of origination of said grooves to the point where said grooves intersect said channel means, said grooves having a depth equivalent to the depth of said channel means at said intersection said channel means being of uniform depth.

* * * * *

UNITED STATES PATENT OFFICE

CERTIFICATE OF CORRECTION

Patent No. 4,005,517 Dated February 1, 1977

Inventor(s) Raymond Arthur Coulter

It is certified that error appears in the above-identified patent and that said Letters Patent are hereby corrected as shown below:

Claim 3, column 7, line 32, after "surface" insert -- of said cylindrical horn, the bottom --.

Claim 16, column 10, line 17, after "insertion" insert -- horn --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*